US010796506B2

(12) United States Patent
Yoshino et al.

(10) Patent No.: US 10,796,506 B2
(45) Date of Patent: Oct. 6, 2020

(54) INFORMATION OUTPUT DEVICE AND INFORMATION OUTPUT METHOD

(71) Applicant: Honda Motor Co., Ltd., Tokyo (JP)

(72) Inventors: Shinya Yoshino, Tokyo (JP); Tomoaki Taki, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/382,141

(22) Filed: Apr. 11, 2019

(65) Prior Publication Data

US 2019/0318554 A1 Oct. 17, 2019

(30) Foreign Application Priority Data

Apr. 13, 2018 (JP) ..... 2018-077824

(51) Int. Cl.
*G07C 5/08* (2006.01)
*G07C 5/12* (2006.01)

(52) U.S. Cl.
CPC ..... *G07C 5/0825* (2013.01); *G07C 5/12* (2013.01)

(58) Field of Classification Search
CPC ..... G07C 5/0825; G07C 5/12; G07C 5/008; G07C 2205/02; G07C 5/0808; G07C 5/0816; G06T 11/206; G09G 5/14; G01R 22/061; G01K 13/028; G06F 11/3089; G06F 16/383; G06F 16/367; G06F 11/32
See application file for complete search history.

(56) References Cited

U.S. PATENT DOCUMENTS 8,135,508 B1 * 3/2012 Thompson ..... G01M 15/04 701/31.8
8,594,883 B2 * 11/2013 Gilbert ..... G07C 5/008 701/33.8
2002/0077779 A1 * 6/2002 Liebl ..... G01R 31/319 702/183
2017/0200294 A1 * 7/2017 Hirano ..... G01P 5/00
2017/0364818 A1 * 12/2017 Wu ..... G06N 20/00
2018/0118376 A1 * 5/2018 Ehrstein ..... G07C 5/0808
2019/0028783 A1 * 1/2019 Clucas ..... H04Q 9/02
2019/0130288 A1 * 5/2019 Boggio ..... B64F 5/10
2019/0130669 A1 * 5/2019 Boggio ..... G06N 3/08
2019/0318554 A1 * 10/2019 Yoshino ..... G07C 5/008

FOREIGN PATENT DOCUMENTS

JP 2016012240 1/2016

* cited by examiner

*Primary Examiner* — An T Nguyen
(74) *Attorney, Agent, or Firm* — JCIPRNET

(57) ABSTRACT

An information output device capable of improving convenience of a device is provided. An information output device includes an image display unit, a user input reception unit, a sensor data input reception unit, and a display control unit. In a case where a second point in time before a first point in time or a designated period is received by the user input reception unit on a first parameter transition image screen, the display control unit displays a first period display image element on the first parameter transition image screen on the image display unit and displays a second period display image element on a second parameter transition image screen on the image display unit.

7 Claims, 15 Drawing Sheets

INFORMATION OUTPUT DEVICE AND INFORMATION OUTPUT METHOD

CROSS-REFERENCE TO RELATED APPLICATION

This application claims the priority of Japan patent application serial no. 2018-077824, filed on Apr. 13, 2018. The entirety of the above-mentioned patent application is hereby incorporated by reference herein and made a part of this specification.

BACKGROUND

Technical Field

The present disclosure relates to an information output device and an information output method.

Description of Related Art

In recent years, devices detecting an abnormality on the basis of data of a plurality of apparatuses and outputting information on the abnormality have become known.

For example, Japanese Patent Laid-Open No. 2016-12240 discloses a device that displays an index value in the vicinity of a time when an abnormality has been detected according to a predetermined rule in a case where an abnormality is detected in any one of a plurality of apparatuses.

[Patent Document 1] Japanese Patent Laid-Open No. 2016-12240

In analyzing the cause of an abnormality, it may be necessary to view data not only at a time at which an abnormality has been detected but also at a time before the abnormality was detected from a plurality of viewpoints.

However, the device disclosed in Japanese Patent Laid-Open No. 2016-12240 merely displays an index value in the vicinity of a time when an abnormality has been detected according to a predetermined rule, and there is room for improvement from the viewpoint of convenience.

SUMMARY

The disclosure provides an information output device and an information output method which are capable of improving the convenience of a device.

According to an embodiment of the present disclosure, there is provided an information output device including an image display unit that displays an image, a user input reception unit that receives a user's input, a sensor data input reception unit that receives an input of sensor data of a vehicle, and a display control unit that switches between a first parameter transition image screen and a second parameter transition image screen in accordance with the user's input received by the user input reception unit and displays the screens on the image display unit, the first parameter transition image screen including a first parameter transition image indicating time-series transitions of first parameters of a plurality of types based on the sensor data of the vehicle which is received by the sensor data input reception unit before a first point in time, and the second parameter transition image screen including a second parameter transition image indicating time-series transitions of second parameters of a plurality of types corresponding to at least some of the first parameters of a plurality of types before the first point in time, wherein in a case where designation of a second point in time before the first point in time or a designated period is received by the user input reception unit on the first parameter transition image screen, the display control unit is configured to cause a first period display image element indicating the second point in time or the designated period on the first parameter transition image screen to be displayed on the image display unit and cause a second period display image element indicating the second point in time or the designated period on the second parameter transition image screen after switching from the first parameter transition image screen to be displayed on the image display unit.

According to the information output device having this configuration, the first parameter transition image screen and the second parameter transition image screen are switched between and displayed on the image display unit by the display control unit in accordance with the user's input received by the user input reception unit.

Here, the first parameter transition image screen is a screen including the first parameter transition image indicating time-series transitions of the first parameters of a plurality of types based on the sensor data of the vehicle which is received by the sensor data input reception unit before the first point in time.

In addition, the second parameter transition image screen is a screen including the second parameter transition image indicating time-series transitions of the second parameters of a plurality of types before the first point in time. The second parameters of a plurality of types are parameters corresponding to at least some of the plurality of types of first parameters.

In this manner according to one of exemplary embodiments of the disclosure, the image elements indicating time-series transitions of the plurality of types of parameters corresponding to each other before the first point in time are displayed on the plurality of screens, so that it is possible to allow the user to examine time-series transitions of the plurality of types of parameters to the first point in time from a plurality of viewpoints.

Further, in a case where the designation of the second point in time before the first point in time or the designated period is received by the user input reception unit on the first parameter transition image screen, the first period display image element indicating the second point in time or the designated period is displayed on the first parameter transition image screen on the image display unit by the display control unit.

In addition, the second period display image element indicating the second point in time or the designated period is displayed on the image display unit by the display control unit also on the second parameter transition image screen after switching from the first parameter transition image screen.

Thereby, according to one of exemplary embodiments of the disclosure, associations between the parameters displayed on the plurality of screens can be easily understood, and thus convenience may be improved.

According to the embodiment, in the information output device, the first parameter transition image may be a first score transition image indicating time-series transitions of a plurality of scores each indicating whether or not the vehicle is in a designated state, the plurality of scores be numerical values determined on the basis of output values of sensors indicated in the sensor data of the vehicle, and the second parameter transition image be a sensor output value transition image indicating time-series transitions of the output values of the sensors indicated in the sensor data of the vehicle.

As described above, according to the information output device of the present disclosure, in a case where the designation of the second point in time before the first point in time or the designated period is received by the user input reception unit on the first parameter transition image screen, the first period display image element indicating the second point in time or the designated period is displayed on the first parameter transition image screen on the image display unit by the display control unit, and the second period display image element indicating the second point in time or the designated period is displayed on the image display unit by the display control unit also on the second parameter transition image screen after switching from the first parameter transition image screen.

Here, according to the information output device having this configuration, the first parameter transition image is a first score transition image indicating time-series transitions of a plurality of scores each indicating whether or not the vehicle is in a designated state, and the second parameter transition image is a sensor output value transition image indicating time-series transitions of the output values of the sensors indicated in the sensor data of the vehicle. In addition, the plurality of scores are numerical values determined on the basis of output values of sensors indicated in the sensor data of the vehicle.

That is, in a case where the designation of the second point in time or the designated period is received on the first parameter transition image screen including the first score transition image indicating the time-series transitions of the scores indicating whether or not the vehicle is in a designated state, the second period display image element indicating the designated second point in time or designated period is also displayed on the second parameter transition image screen together with the sensor output value transition image indicating the time-series transitions of the output values of the sensors.

Thereby, for example, when the user examines general trends in the state of the vehicle on the first parameter transition image screen and analyzes the output values of the sensors in more detail on the second parameter transition image screen, it is possible to allow the user to recognize associations between the general trends in the state of the vehicle and the output values of the sensors.

According to the embodiment, in the information output device having this configuration, the second parameter transition image screen may include a score image indicating one or a plurality of scores of at least some of the plurality of scores.

According to the information output device having this configuration, the score image indicating one or a plurality of scores of at least some of the plurality of scores is displayed on the second parameter transition image screen indicating the time-series transitions of the output values of the sensors indicated in the sensor data of the vehicle. Thereby, for example, when the user examines the output values of the sensors on the second parameter transition image screen, the user can recognize at least some of the plurality of scores, and thus convenience may be improved.

According to the embodiment, in the information output device having this configuration, one or a plurality of scores indicated in the score image may be scores at the second point in time, or one or a plurality of scores indicated in the score image may be representative values of scores in the designated period.

As described above, according to the information output device of the present disclosure, in a case where the designation of the second point in time before the first point in time or the designated period is received by the user input reception unit on the first parameter transition image screen, the second period display image element indicating the second point in time or the designated period is displayed on the image display unit by the display control unit also on the second parameter transition image screen after switching from the first parameter transition image screen. Further, the second parameter transition image screen includes the score image indicating one or a plurality of scores of at least some of the plurality of scores together with the sensor output value transition image indicating the time-series transitions of the output values of the sensors.

According to the information output device having this configuration, one or a plurality of scores indicated in the score image are scores at the second point in time, or one or a plurality of scores indicated in the score image are representative values of scores in the designated period.

Thereby, for example, in a case where the user designates the second point in time or the designated period as a point in time or a period desired to be noted on the first parameter transition image screen, the sensor output value transition image indicating the time-series transitions of the output values of the sensors and the second period display image element indicating the second point in time or the designated period are displayed on the second parameter transition image screen, and one or a plurality of scores at the second point in time or representative values of one or a plurality of scores in the designated period are displayed thereon.

Thereby, according to one or some of exemplary embodiments of the disclosure, it is possible to allow the user to ascertain a relation between the time-series transitions of the output values of the sensors at the designated second point in time or in the designated period and the representative values of the scores at the second point in time or the scores in the designated period, and thus convenience may be improved.

According to the embodiment, in these information output devices, the display control unit may be configured to display a total score transition image screen including a second score transition image indicating time-series transitions of a total score calculated from a plurality of scores on the image display unit in accordance with the user's input received through the user input reception unit.

According to the information output device having this configuration, the total score transition image screen including the second score transition image indicating the time-series transitions of the total score calculated from the plurality of scores is displayed on the image display unit by the display control unit in accordance with the user's input received through the user input reception unit.

Thereby, according to one or some of exemplary embodiments of the disclosure, it is possible to allow the user to recognize a relation between the plurality of scores indicated in the first score transition image displayed on the first parameter transition image screen, and thus convenience may be improved.

DESCRIPTION OF THE EMBODIMENTS (First Embodiment)

A first embodiment of the present disclosure will be described with reference to FIGS. 1 to 12.

Figure 1:
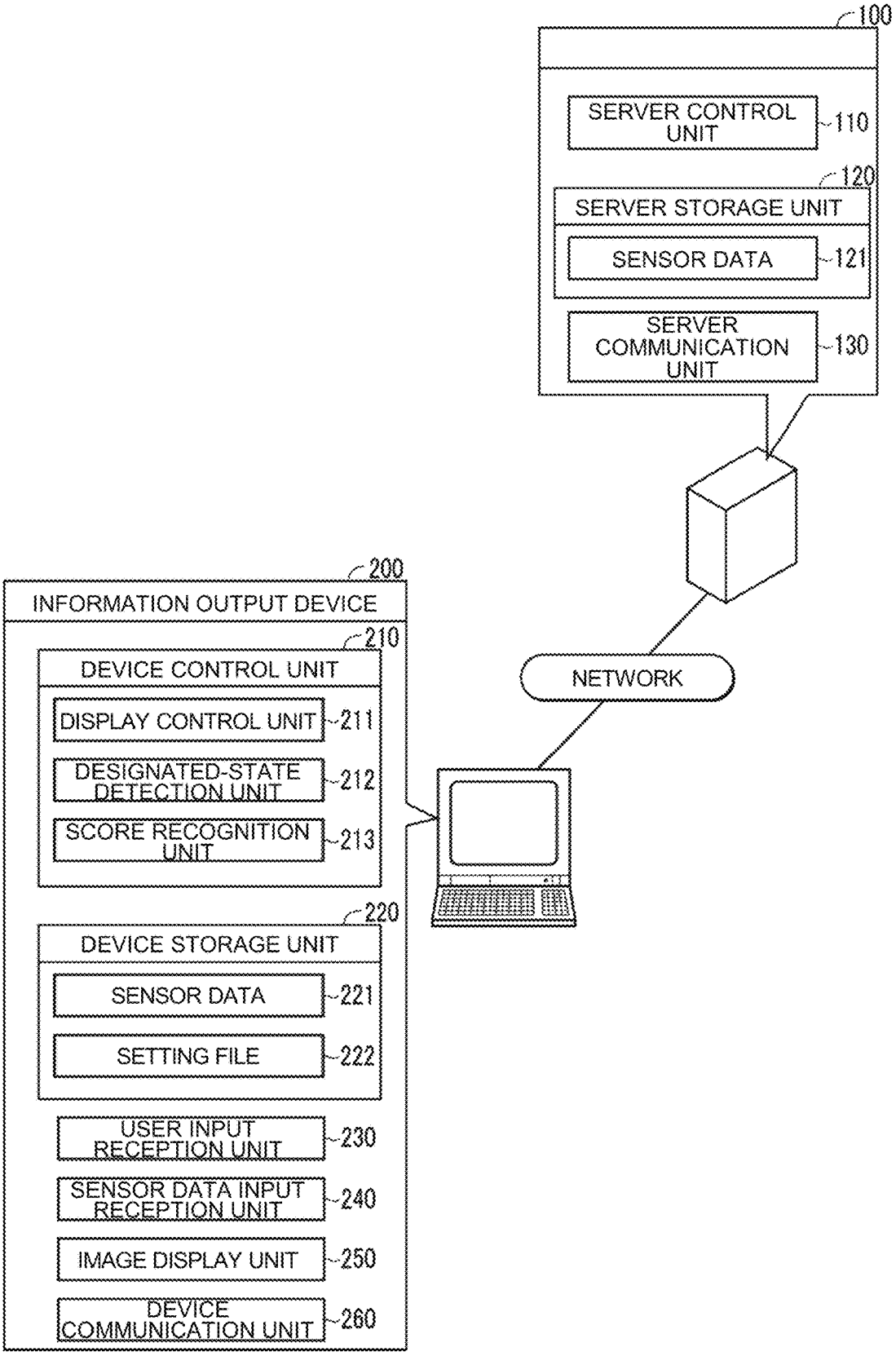
FIG. 1 is a diagram showing an example of a configuration of an information output system of the present disclosure.

In the first embodiment, an information output system includes a server 100 and an information output device 200 as shown in FIG. 1. The server 100 and the information output device 200 are capable of communicating to each other through a network such as a wireless communication network.

(Configuration of Server)

The server 100 is constituted by a computer as a fixed station, and includes a server control unit 110, a server storage unit 120, and a server communication unit 130. Note that, the server 100 may be constituted by a portable terminal device such as a smartphone or a tablet as a mobile station. The server 100 may be configured such that a plurality of computers communicates with each other to perform functions of the server control unit 110, the server storage unit 120, the server communication unit 130, and the like in cooperation with each other.

The server control unit 110 is constituted by an arithmetic processing device (for example, center processing unit, CPU) that reads data from the server storage unit 120 as required and then executes arithmetic processing operation on the data according to an information output server program. Details of the arithmetic processing will be described later.

The server storage unit 120 is constituted by a storage device such as a random access memory (RAM), a read-only memory (ROM), or a hard disk drive (HDD) and is configured to store and hold received information received by the server control unit 110 and results of the arithmetic processing operations such as calculation results. The server storage unit 120 store and holds sensor data 121 received from the information output device 200.

(Configuration of Information Output Device)

The information output device 200 is an information terminal, such as a tablet type terminal or a smartphone, of which the size, shape, and weight are designed so as to be portable for a user, as a mobile station.

The information output device 200 may be constituted by an information terminal of which the size, for example, standardized to 1DIN to 2DIN, for example, as defined in ISO 7736, and the like are designed so as to be mountable on a mobile object on which a first user U1 boards. In addition, the information output device 200 may be constituted by, for example, a desktop computer as a fixed station.

As shown in FIG. 1, the information output device 200 includes a device control unit 210, a device storage unit 220, a user input reception unit 230, a sensor data input reception unit 240, an image display unit 250, and a device communication unit 260. The information output device 200 may include not only a component inside the device but also include a component outside the device, and may be configured to recognize necessary data through wired communication or wireless communication.

Note that "recognition" of information by a certain device means that all arithmetic processing for acquiring the information is executed, for example, reception of the information by the device from another device, acquisition of the information stored in a storage medium such as the device storage unit 220 by the device, acquisition of the information on the basis of a signal output from a sensor by the device, derivation of the information by executing predetermined arithmetic processing (calculation processing, retrieval processing, or the like) on the basis of the received information, information stored in a storage medium such as the device storage unit 220, or information acquired from an external sensor by the device, reception of the information as arithmetic processing results, obtained by another device, by the device from another device, and reading of the information by the device from an internal storage device or an external storage device in accordance with a received signal.

The device control unit 210 is constituted by a processor such as a CPU. An information output program is installed in the information output device 200. When the information output program is started up, the device control unit 210 is configured to read software and data from the device storage unit 220 as required and then execute arithmetic processing to be described later. The device control unit 210 executing arithmetic processing to be described later functions as a display control unit 211, a designated-state detection unit 212, and a score recognition unit 213.

A portion or the entirety of the device control unit 210 may be constituted by the external server 100 or the like which is able to communicate through the device communication unit 260.

The device control unit 210 is configured to be capable of transmitting and receiving information to and from the device storage unit 220, the user input reception unit 230, the sensor data input reception unit 240, the image display unit 250, and the device communication unit 260.

The device storage unit 220 is constituted by a storage device such as a RAM, a ROM, or an HDD and is configured to store various information. The device storage unit 220 is configured to be capable of storing and reading out data used in arithmetic processing by the device control unit 210. A portion or the entirety of the device storage unit 220 may be constituted by an external storage server or the like which is able to communicate through the device communication unit 260.

The device storage unit 220 stores sensor data 221 and a setting file 222.

The sensor data 221 is data including values output from various sensors mounted on a vehicle and input through the sensor data input reception unit 240, times when the values have been output, and sensor IDs for identifying the sensors.

The setting file 222 includes one or a plurality of IDs of sensors which are displayed on a second parameter transition image screen M2 to be described later.

The user input reception unit 230 is constituted by, for example, a touch pad. The user input reception unit 230 is configured to detect a user's operation and to output a signal corresponding to the touch operation to the device control unit 210. Alternatively, or additionally, the user input reception unit 230 may be constituted by a microphone, a keyboard, a mouse, or the like.

The sensor data input reception unit 240 is connected to a diagnosis device of a vehicle in a wired or wireless manner and is configured to recognize sensor data. Alternatively, the sensor data input reception unit 240 may communicate with a telematics unit mounted on the vehicle to recognize sensor data. In addition, the sensor data input reception unit 240 may communicate with the server 100 in accordance with the user's operation detected through the user input reception unit 230 to recognize sensor data of a designated vehicle among pieces of sensor data stored in the server 100.

The image display unit 250 is constituted by, for example, a liquid crystal panel. The image display unit 250 is configured to display an image in accordance with a signal input from the device control unit 210.

A combination of a touch pad as the user input reception unit 230 and a liquid crystal panel as the image display unit 250 may be configured as a touch panel.

The device communication unit 260 may be configured to mutually communicate with an apparatus in accordance with a communication standard suitable for wired communication or wireless communication over a short distance such as WiFi (registered trademark) or wireless communication over a long distance through a wireless LAN or the like.

(First Parameter Transition Image Screen Display Process)

Next, a first parameter transition image screen display process will be described with reference to FIGS. 2 and 3.

Figure 2:
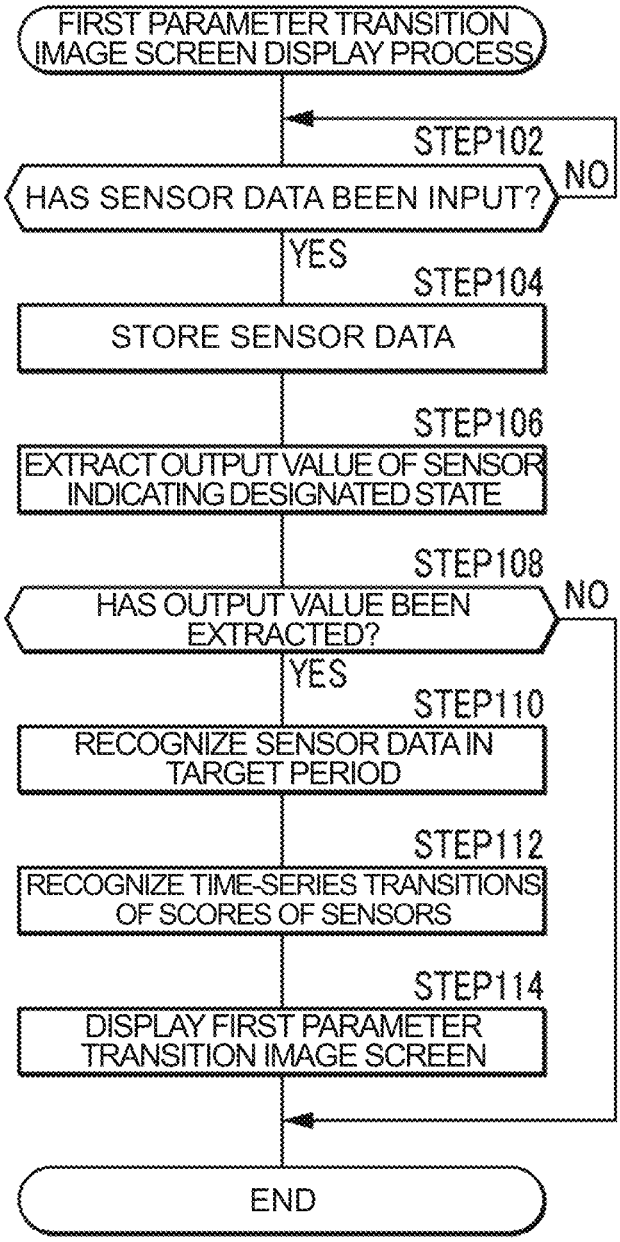
FIG. 2 is a flowchart of a first parameter transition image screen display process.

The designated-state detection unit 212 determines whether or not sensor data has been input through the sensor data input reception unit 240 (FIG. 2/STEP102). Hereinafter, a vehicle collecting sensor data by the diagnosis device will be referred to as a "target vehicle" as appropriate.

In a case where the determination result is negative (FIG. 2/STEP102 is determined to be NO), the designated-state detection unit 212 executes the processing of FIG. 2/STEP102.

In a case where the determination result is affirmative (FIG. 2/STEP102 is determined to be YES), the designated-state detection unit 212 stores the sensor data input in FIG. 2/STEP102 in the device storage unit 220 (FIG. 2/STEP104).

The designated-state detection unit 212 extracts an output value of a sensor indicating a designated state from the sensor data input in FIG. 2/STEP102 (FIG. 2/STEP106). Here, the designated state refers to the state of a target vehicle which is distinguishable from other states. Examples of the designated state include a state where any one or a plurality of apparatuses mounted on the target vehicle are abnormal, a state where the target vehicle is traveling at a predetermined speed or higher, and the like. For example, the designated-state detection unit 212 may extract an output value of a sensor departing from a range determined for each type of sensor. In addition, the designated-state detection unit 212 may extract an output value of a sensor indicating a designated state using a classifier generated by supervised learning or unsupervised learning.

The designated-state detection unit 212 determines whether or not an output value of a sensor indicating a designated state has been extracted (FIG. 2/STEP108).

In a case where the determination result is negative (FIG. 2/STEP108 is determined to be NO), the device control unit 210 terminates the present process.

In a case where the determination result is affirmative (FIG. 2/STEP108 is determined to be YES), the score recognition unit 213 recognizes sensor data in a target period (FIG. 2/STEP110). Here, in an embodiment, the target period includes a period from a point in time when an output value of a sensor indicating a designated state is output to a point in time before a predetermined time (for example, from a first point in time to a point in time before 30 seconds). The predetermined time may be a predetermined time, or may be a time designated through the user input reception unit 230. Hereinafter, a "target period" will be referred to as a "total period" as appropriate. Hereinafter, a reference point in time in the present process (in the present embodiment, a point in time when an output of a sensor indicating a designated state is output) will be referred to as a "first point in time" as appropriate.

The score recognition unit 213 recognizes time-series transitions of scores of sensors on the basis of output values of the sensors at points in time in the whole period included in the sensor data in the whole period which is recognized in FIG. 2/STEP110 (FIG. 2/STEP112). The score of each of the sensors is a degree indicating whether or not the state of a target vehicle (or an apparatus to be sensed by each sensor) is the designated state. A score of each sensor may increase continuously or intermittently in a case where a value output from each sensor indicates that the state of a target vehicle (or an apparatus to be sensed by each sensor) is the designated state or is close to the designated state, and a score of each sensor may decrease continuously or intermittently in a case where a value output from each sensor indicates that the state of a target vehicle (or an apparatus to be sensed) deviates from a designated state. A score of each sensor is equivalent to an example of a "first parameter" of the present disclosure, and an output value of each sensor is equivalent to an example of a "second parameter" of the present disclosure.

The display control unit 211 displays a first parameter transition image screen M1 on the image display unit 250 (FIG. 2/STEP114).

Figure 3:
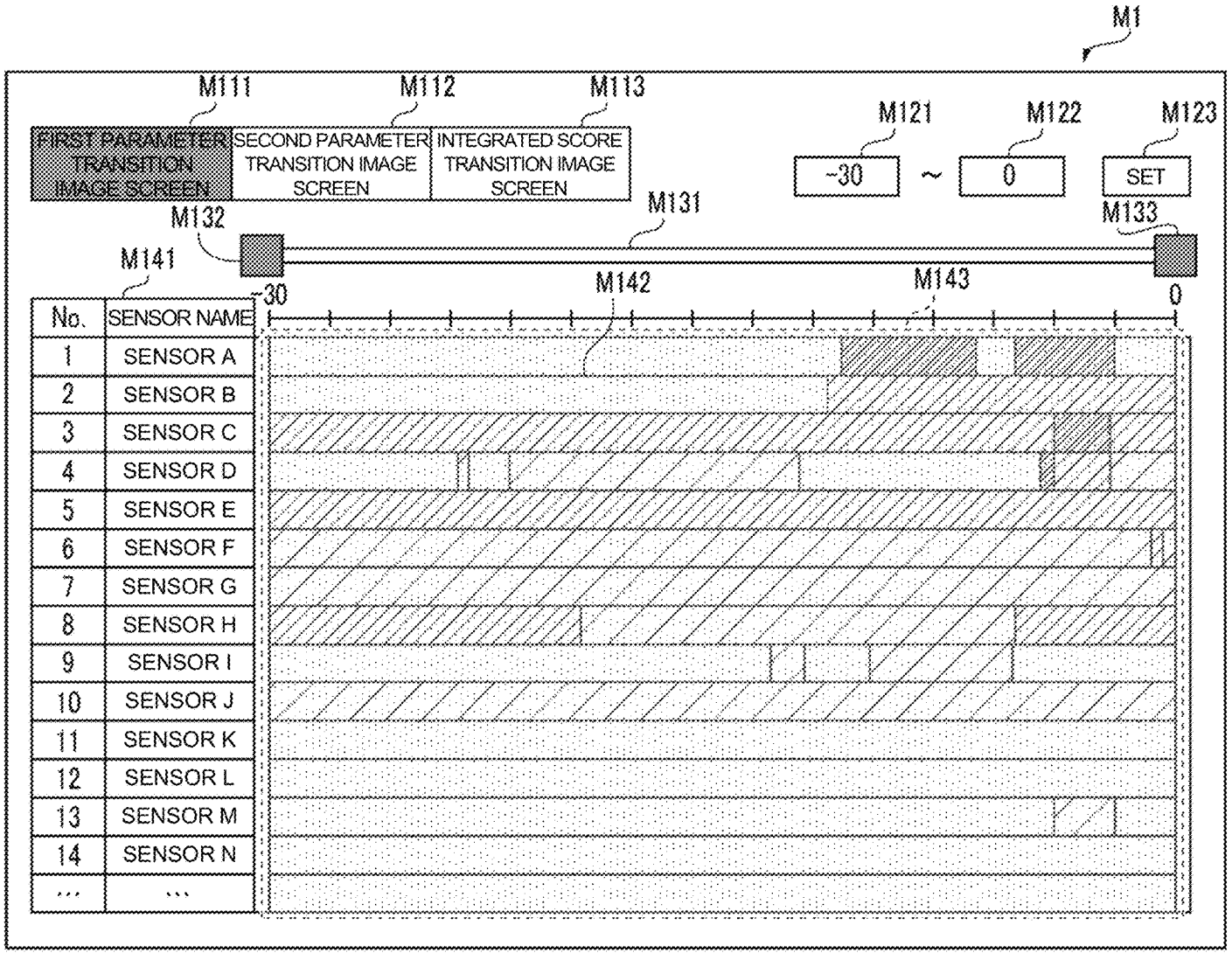
FIG. 3 is a diagram showing an example of the first parameter transition image screen.

As shown in FIG. 3, the first parameter transition image screen M1 includes a first parameter transition image screen display button M111, a second parameter transition image screen display button M112, a total score transition image screen display button M113, a first input box M121, a second input box M122, a set button M123, a slide bar M131, a first slider M132, a second slider M133, a sensor name list M141, a first score transition image M142, and a first period display image element M143. The first period display image element M143 is equivalent to an example of a "first period display image element" of the present disclosure.

The first parameter transition image screen display button M111 corresponding to a screen being displayed is indicated in a color different from those of the other screen display buttons (the second parameter transition image screen display button M112 and the total score transition image screen display button M113).

The first input box M121 and the second input box M122 are configured such that an integer or a number equal to or less than 0 of one effective digit after a decimal point can be input. Numerical values input to the first input box M121 and the second input box M122 are numerical values indicating how many seconds before a first point in time. For example, the first point in time is indicated by 0, and one second before the first point in time is indicated by −1.

The set button M123 is a button for fixedly setting numerical values which are input to the first input box M121 and the second input box M122.

When a pressing operation of the set button M123 is detected through the user input reception unit 230, the display control unit 211 is configured to acquire two numerical values input to the first input box M121 and the second input box M122 and recognize a period represented by the two numerical values.

Each position on the slide bar M131 is associated with a numerical value (for example, a difference in seconds between the point in time and the first point in time) indicating each point in time included in the whole period which is recognized in FIG. 2/STEP110.

The display control unit 211 displays the first slider M132 and the second slider M133 so as to slide on the slide bar M131 in accordance with a user's operation through the user input reception unit 230. In addition, the display control unit 211 recognizes a period corresponding to the positions of the first slider M132 and the second slider M133.

In addition, the display control unit 211 is configured to display a numerical value corresponding to the position of the first slider M132 or the second slider M133 on the first input box M121 or the second input box M122 when an operation of the first slider M132 or the second slider M133 is detected through the user input reception unit 230.

In addition, when a pressing operation of the set button M123 is detected through the user input reception unit 230, the display control unit 211 displays the first slider M132 and the second slider M133 at two positions on the slide bar M131 corresponding to numerical values input to the first input box M121 and the second input box M122.

The sensor name list M141 is a list of names of sensors specified from sensor IDs included in sensor data.

The first score transition image M142 is an image indicated by shading with respect to a score of each sensor at each point in time. The display control unit 211 generates the first score transition image M142 such that color (for example, red) at a position corresponding to each point in time and each sensor becomes darker as a score of each sensor at each point in time approaches a value indicating a designated state (for example, abnormality) and color at a position corresponding to each point in time and each sensor becomes lighter as the score deviates from a value indicating a designated state (for example, abnormality).

The first period display image element M143 is an image element indicating a period designated by the first input box M121, the second input box M122, and the set button M123 or the first slider M132 and the second slider M133. The first period display image element M143 may be an image element that displays a designated period so as to be distinguishable from other periods, or may be an image element represented in a color different from those of the other portions or surrounded by a frame line or the like. For example, the display control unit 211 sets the position of the first score transition image M142 corresponding to a designated period to be a specific color (for example, yellow) as the first period display image element M143. Here, the term "image element" means an element constituting an image. The term "image element" means not only an image itself indicating characters, numerical values, graphs, tables, slide bars, buttons, and the like but also some elements of an image such as lines, shading, colors, and the like used for the image.

(Period Display Image Element Display Process)

Figure 5:
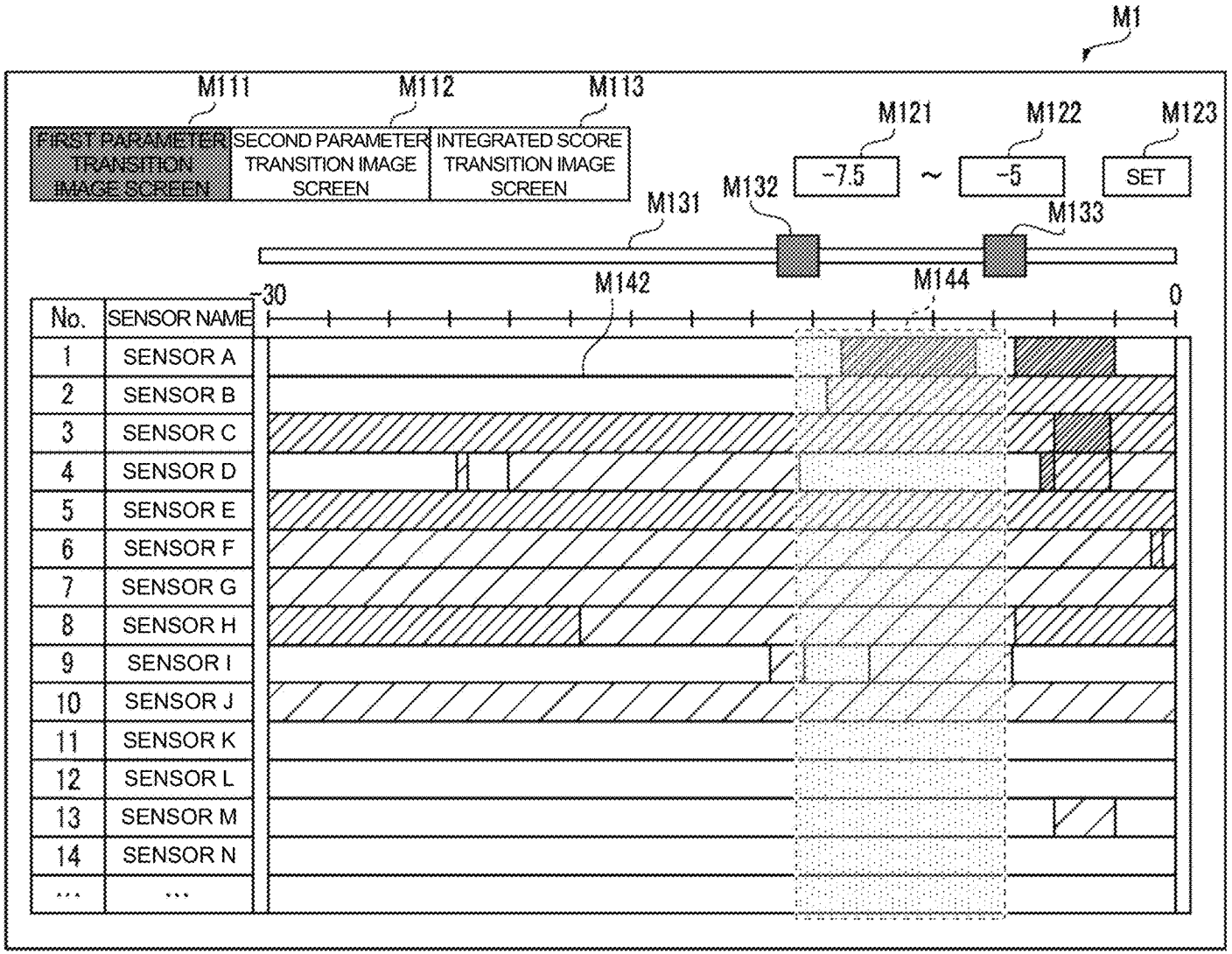
FIG. 5 is a diagram showing an example of the first parameter transition image screen including a first period display image element corresponding to a designated period.
Figure 6:
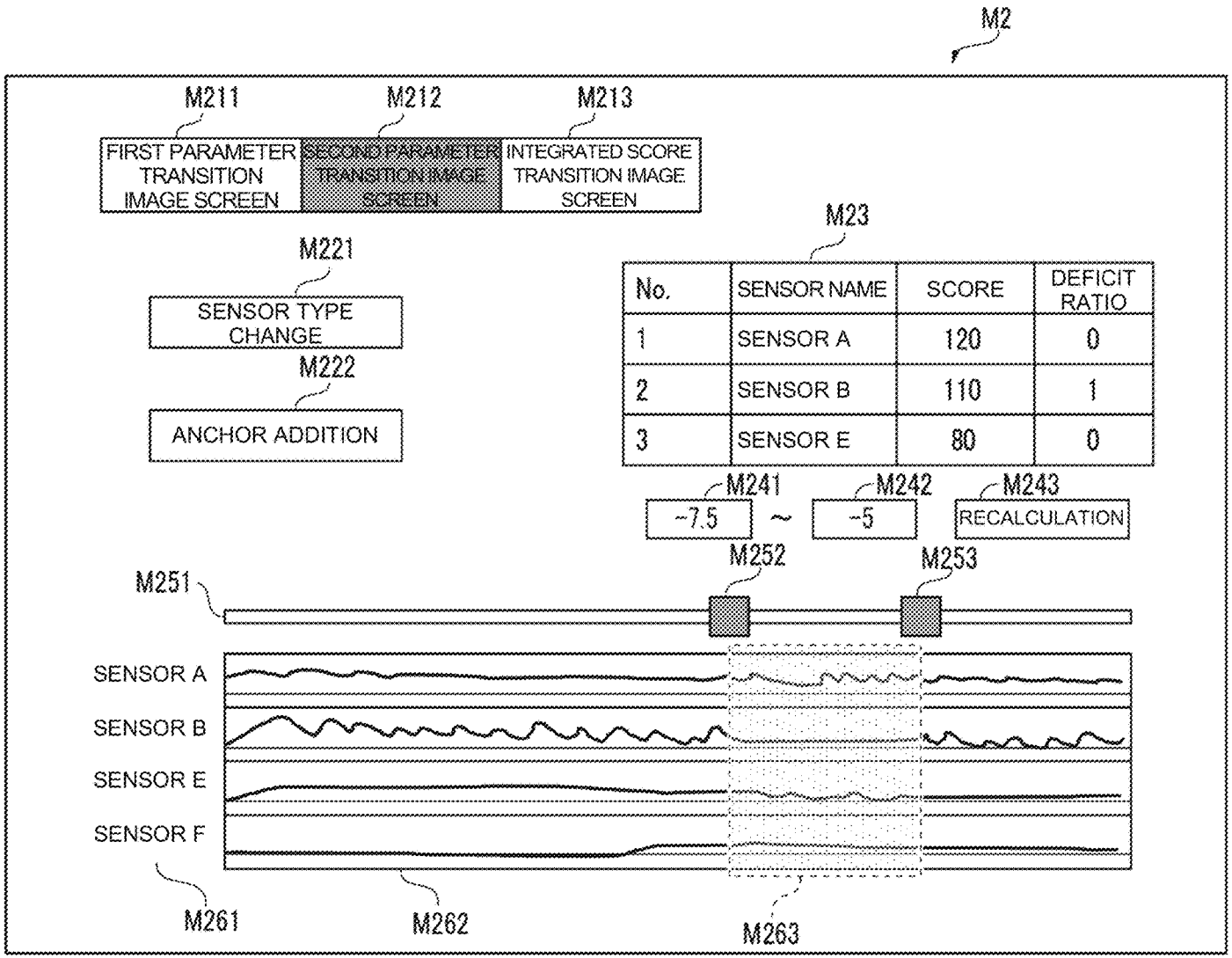
FIG. 6 is a diagram showing an example of a second parameter transition image screen.

Next, a period display image element display process will be described with reference to FIGS. 4 to 6.

In an initial state in the present process, the first parameter transition image screen M1 is displayed on the image display unit 250.

Figure 4:
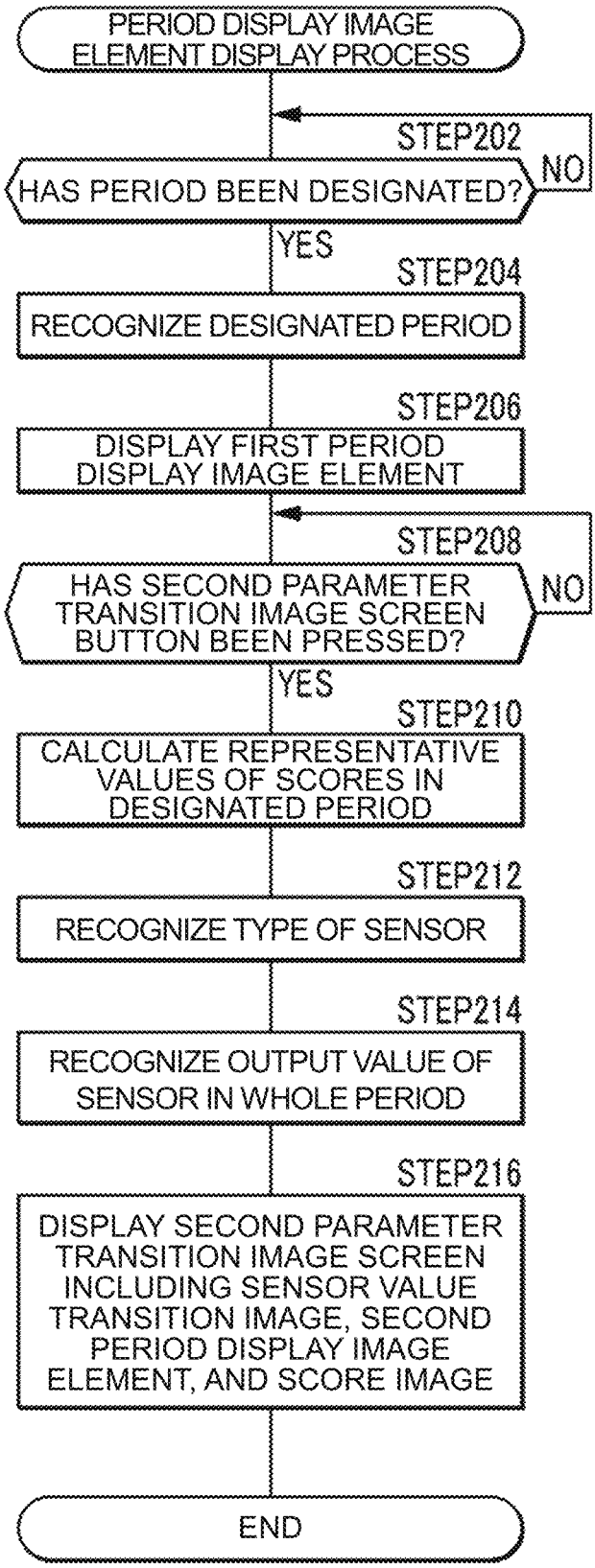
FIG. 4 is a flowchart of a period display image element display process.

The display control unit 211 determines whether or not a period has been designated through the user input reception unit 230 (FIG. 4/STEP202). More specifically, the display control unit 211 determines whether or not a pressing operation of the set button M123 or an operation for the first slider M132 or the second slider M133 has been detected through the user input reception unit 230.

In a case where the determination result is negative (FIG. 4/STEP202 is determined to be NO), the display control unit 211 executes the processing of FIG. 4/STEP202.

In a case where the determination result is affirmative (FIG. 4/STEP202 is determined to be YES), the display control unit 211 recognizes the period designated in FIG. 4/STEP202 (FIG. 4/STEP204). Hereinafter, a period designated on the first parameter transition image screen M1 will be referred to as a "first designated period" as appropriate.

For example, in a case where a pressing operation of the set button M123 is detected, the display control unit 211 recognizes a numerical value input to the first input box M121 indicating the commencement of a first designated period and a numerical value input to the second input box M122 indicating the termination of the first designated period. In addition, for example, in a case where an operation for the first slider M132 or the second slider M133 is detected, the display control unit 211 recognizes a numerical value corresponding to the position of the first slider M132 indicating the commencement of the first designated period and a numerical value corresponding to the position of the second slider M133 indicating the termination of the first designated period.

The display control unit 211 displays a first period display image element M144 at a position on the first score transition image M142 which corresponds to the first designated period (FIG. 4/STEP206). For example, as shown in FIG. 5, the display control unit 211 displays a portion from a position on the first score transition image M142 which corresponds to the position of the first slider M132 to a position on the first score transition image M142 which corresponds to the position of the second slider M133 in a specific color (for example, yellow) as the first period display image element M144.

The display control unit 211 determines whether or not a pressing operation for a second parameter transition image screen button M112 has been detected through the user input reception unit 230 (FIG. 4/STEP208).

In a case where the determination result is negative (FIG. 4/STEP208 is determined to be NO), the display control unit 211 executes the processing of FIG. 4/STEP208.

In a case where the determination result is affirmative (FIG. 4/STEP208 is determined to be YES), the score recognition unit 213 calculates representative values of scores of the sensors in the first designated period (FIG. 4/STEP210). A representative value of a score of a certain sensor in the first designated period is, for example, an average value, an intermediate value, a maximum value, or a minimum value of the score of the sensor in the first designated period.

The display control unit 211 recognizes an ID of a sensor with reference to the setting file 222 (FIG. 4/STEP212).

The display control unit 211 recognizes time-series transitions of output values of the sensor identified by the ID recognized in FIG. 4/STEP212 in the whole period (FIG. 4/STEP214).

The display control unit 211 displays the second parameter transition image screen M2 on the image display unit 250 (FIG. 4/STEP216).

The second parameter transition image screen M2 is a screen including a first parameter transition image screen display button M211, a second parameter transition image screen display button M212, a total score transition image screen display button M213, a sensor type change button M221, an anchor addition button M222, a score image M23, a third input box M241, a fourth input box M242, a recalculation button M243, a slide bar M251, a third slider M252, a fourth slider M253, a sensor list M261, a sensor output value transition image M262, and a second period display image element M263. The second period display image element M263 is equivalent to an example of a "second period display image element" of the present disclosure.

The second parameter transition image screen display button M212 corresponding to a screen being displayed is indicated in a color different from those of the other screen display buttons (the first parameter transition image screen display button M211 and the total score transition image screen display button M213).

Processing performed when a pressing operation of the sensor type change button M221 or the anchor addition button M222 is detected will be described later.

The score image M23 indicates rankings of representative values of scores in the first designated period. The score image M23 is an image including representative values of scores in the first designated period corresponding to a predetermined number from an upper score. The representative values of the scores included in the score image M23 are arranged in descending order.

The third input box M241 and the fourth input box M242 have the same configurations of the first input box M121 and the second input box M122, respectively.

The slide bar M251, the third slider M252, and the fourth slider M253 have the same configurations of the slide bar M131, the first slider M132, and the second slider M133, respectively.

When a pressing operation of the recalculation button M243 is detected through the user input reception unit 230, the display control unit 211 recognizes a numerical value input to the third input box M241 as the commencement of a designated period and a numerical value input to the fourth input box M242 as the termination of the designated period. Hereinafter, a period designated on the second parameter transition image screen M2 will be referred to as a "second designated period" as appropriate.

In addition, when operations for the third slider M252 and the fourth slider M253 are detected through the user input reception unit 230, the display control unit 211 recognizes a numerical value corresponding to the position of the third slider M252 as the commencement of a second designated period and a numerical value corresponding to the position of the fourth slider M253 as the termination of the second designated period.

The score recognition unit 213 calculates representative values of sensors in the second designated period on the basis of the recognized commencement of the second designated period and the recognized termination of the second designated period.

In addition, the display control unit 211 updates the value input to the third input box M241, the value input to the fourth input box M242, the score image M23, the position of the third slider M252, the position of the fourth slider M253, and the second period display image element M263.

The sensor list M261 is a list of names of the sensors identified by the IDs of the sensors which are recognized in FIG. 4/STEP212.

The sensor output value transition image M262 is a graph showing the time-series transitions of the output values of the sensors which are recognized in FIG. 4/STEP214 in the whole period.

The second period display image element M263 is an image element indicating a first designated period or a second designated period. The second period display image element M263 may be an image element that displays a first designated period or a second designated period so as to be distinguishable from other periods, or may be an image element represented in a color different from those of the other portions or surrounded by a frame line or the like. For example, the display control unit 211 displays the position of the sensor output value transition image M262 corresponding to a designated period in a specific color (for example, yellow) as the second period display image element M263.

(Sensor Type Changing Process)

Next, a sensor type changing process will be described with reference to FIGS. 7 and 8.

In an initial state in the present process, the second parameter transition image screen M2 is displayed on the image display unit 250.

Figure 7:
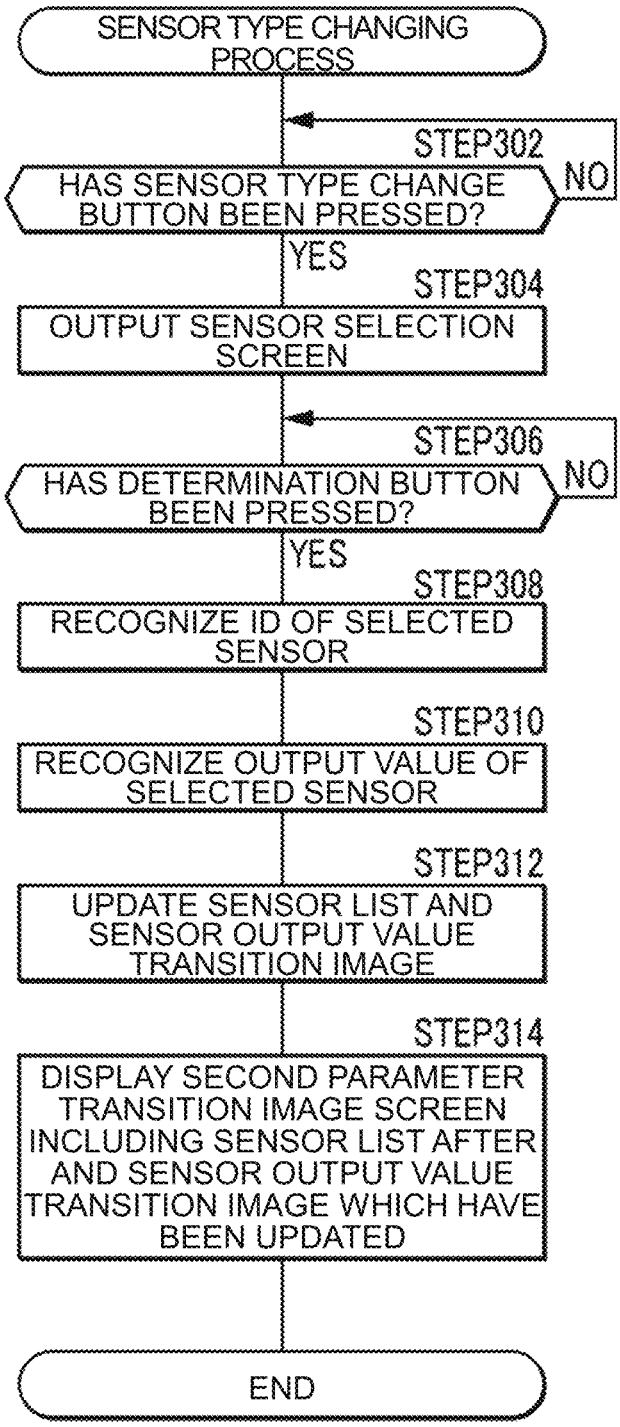
FIG. 7 is a flowchart of a sensor type changing process.
Figure 8:
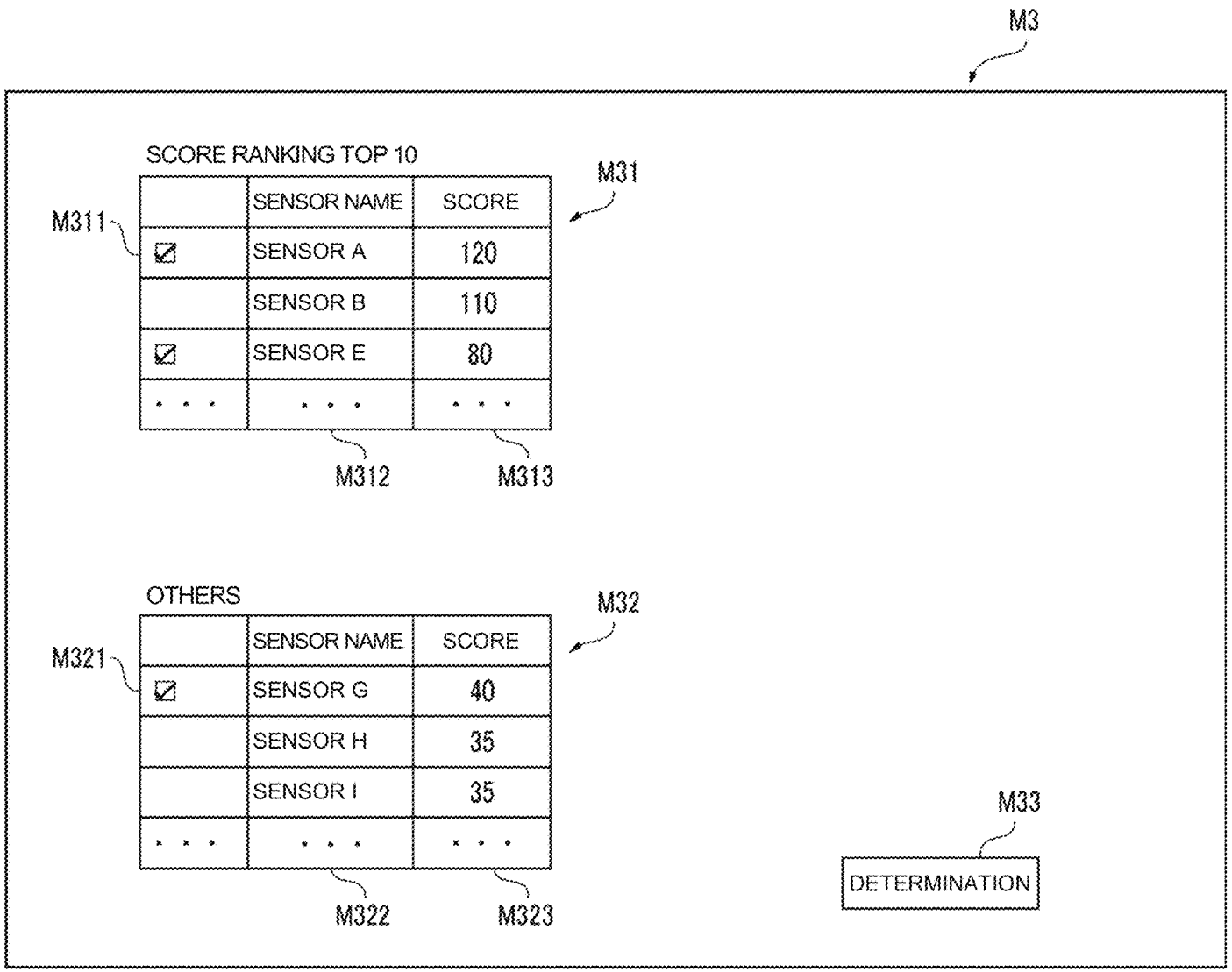
FIG. 8 is a diagram showing an example of a sensor selection screen.

The display control unit 211 determines whether or not a pressing operation of the sensor type change button M221 has been detected through the user input reception unit 230 (FIG. 7/STEP302).

In a case where the determination result is negative (FIG. 7/STEP302 is determined to be NO), the display control unit 211 executes the processing of FIG. 7/STEP302.

In a case where the determination result is affirmative (FIG. 7/STEP302 is determined to be YES), the display control unit 211 displays a sensor selection screen M3 on the image display unit 250 (FIG. 7/STEP304). The sensor selection screen M3 is a screen including a first sensor selection box M31, a second sensor selection box M32, and a determination button M33 as shown in FIG. 8.

The first sensor selection box M31 is a list including a predetermined number of upper representative values of scores in a first designated period or a second designated period.

The first sensor selection box M31 is an image including a selection column M311 for selecting each of sensors, a name column M312 for each of the sensors, and a score column M313 for each of the sensors.

The second sensor selection box M32 is a list of sensors other than the sensors included in the first sensor selection box M31. The second sensor selection box M32 is an image including a selection column M321 for selecting each of sensors, a name column M322 for each of the sensors, and a score column M323 for each of the sensors, similar to the first sensor selection box M31.

The display control unit 211 determines whether or not a pressing operation of the determination button M33 has been detected through the user input reception unit 230 (FIG. 7/STEP306).

In a case where the determination result is negative (FIG. 7/STEP306 is determined to be NO), the display control unit 211 executes the processing of FIG. 7/STEP306.

In a case where the determination result is affirmative (FIG. 7/STEP306 is determined to be YES), the score recognition unit 213 recognizes an ID of a sensor checked in each selection column M311 (FIG. 7/STEP308).

The score recognition unit 213 recognizes an output value of the sensor identified by the ID recognized in FIG. 7/STEP308 (FIG. 7/STEP310).

The display control unit 211 updates the sensor list M261 and the sensor output value transition image M262 which are to be displayed on the second parameter transition image screen M2 on the basis of the ID recognized in FIG. 7/STEP308 and the output value of the sensor recognized in FIG. 7/STEP310 (FIG. 7/STEP312).

The display control unit 211 displays the second parameter transition image screen M2 including the sensor list M261 and the sensor output value transition image M262 which have been updated in FIG. 7/STEP312 on the image display unit 250 (FIG. 7/STEP314).

(Anchor Display Process)

Next, an anchor display process will be described with reference to FIGS. 9 and 10.

In an initial state in the present process, the second parameter transition image screen M2 is displayed on the image display unit 250.

Figure 9:
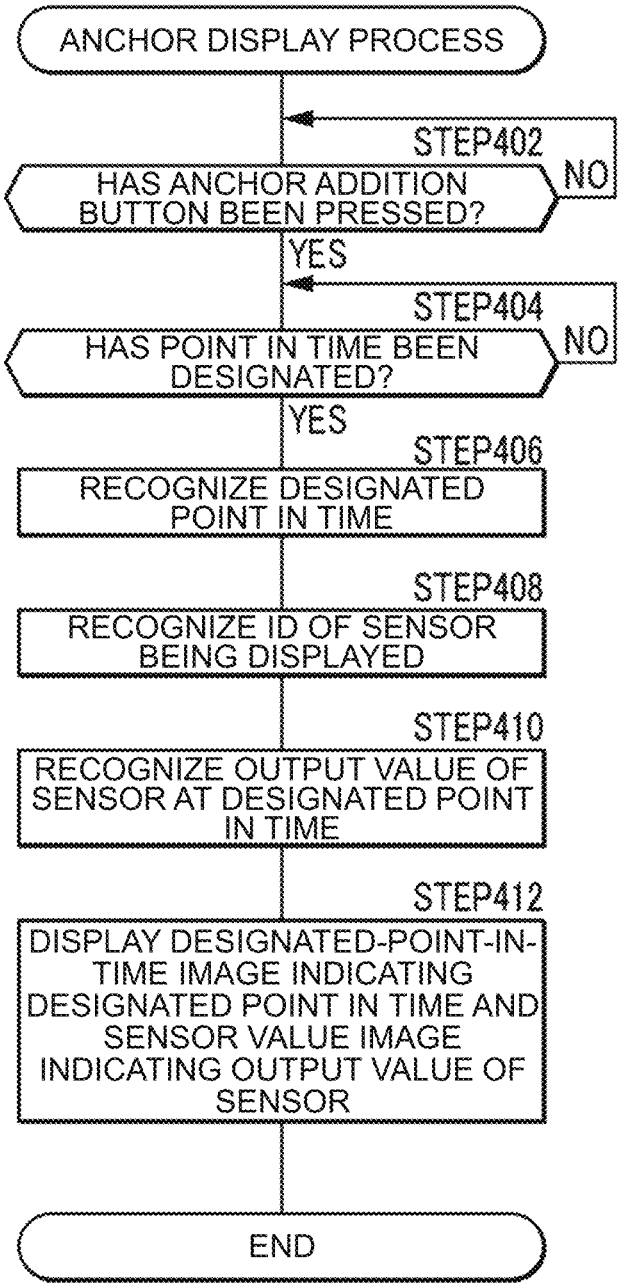
FIG. 9 is a flowchart of an anchor display process.

The display control unit 211 determines whether or not a pressing operation of the anchor addition button M222 has been detected through the user input reception unit 230 (FIG. 9/STEP402).

In a case where the determination result is negative (FIG. 9/STEP402 is determined to be NO), the display control unit 211 executes the processing of FIG. 9/STEP402.

In a case where the determination result is affirmative (FIG. 9/STEP402 is determined to be YES), the display control unit 211 determines whether or not designation of a point in time has been detected through the user input reception unit 230 (FIG. 9/STEP404). For example, the display control unit 211 determines whether or not a pressing operation has been detected on the sensor output value transition image M262.

In a case where the determination result is negative (FIG. 9/STEP404 is determined to be NO), the display control unit 211 executes the processing of FIG. 9/STEP404.

In a case where the determination result is affirmative (FIG. 9/STEP404 is determined to be YES), the display control unit 211 recognizes the designated point in time (hereinafter, referred to as a "designated point in time") (FIG. 9/STEP406). For example, in a case where a pressing operation has been detected on the sensor output value transition image M262, the display control unit 211 recognizes a point in time corresponding to a position where the pressing operation has been performed as a designated point in time.

The display control unit 211 recognizes an ID of a sensor displayed in the sensor list M261 of the second parameter transition image screen M2 (FIG. 9/STEP408).

The display control unit 211 recognizes an output value of a sensor at a designated point in time on the basis of the recognized ID of the sensor (FIG. 9/STEP410).

Figure 10:
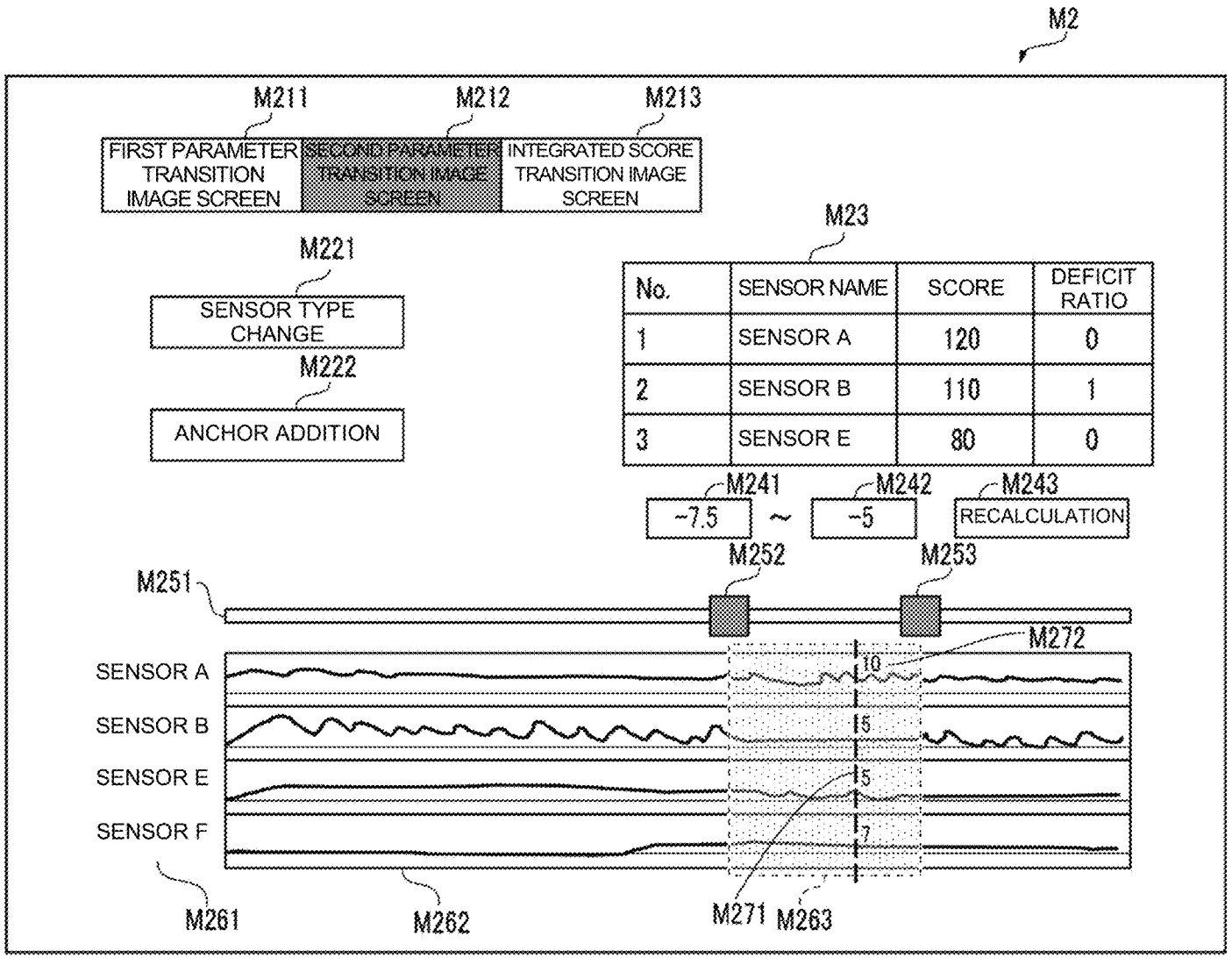
FIG. 10 is a diagram showing an example of the second parameter transition image screen including an anchor.

As shown in FIG. 10, the display control unit 211 outputs a designated-point-in-time image M271 (anchor) indicating a designated point in time and a sensor output value image M272 indicating an output value of each sensor at the designated point in time to the image display unit 250 so as to be superimposed on the sensor output value transition image M262 (FIG. 9/STEP412).

(Integrated Score Transition Image Screen Display Process)

Next, a total score transition image screen display process will be described with reference to FIGS. 11 to 13.

In an initial state in the present process, the first parameter transition image screen M1 or the second parameter transition image screen M2 is displayed on the image display unit 250.

Figure 11:
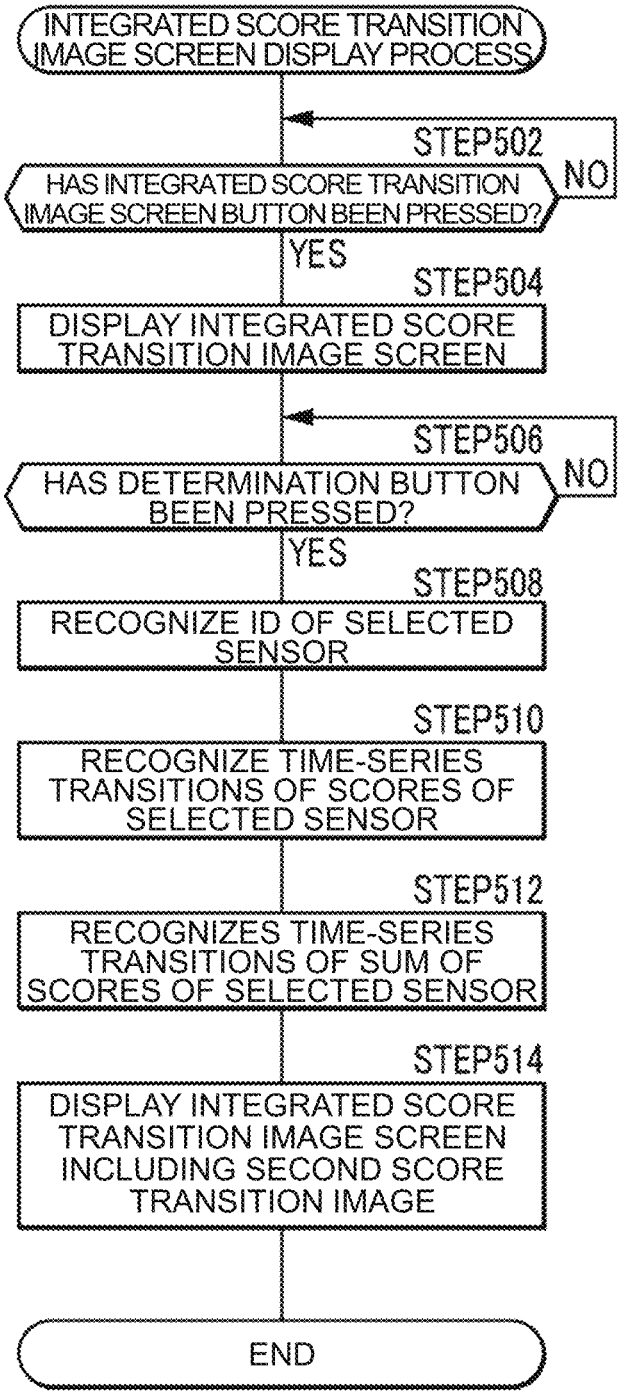
FIG. 11 is a flowchart of a total score transition image screen display process.

The display control unit 211 determines whether or not a pressing operation of the total score transition image screen display button M113 or M213 has been detected through the user input reception unit 230 (FIG. 11/STEP502).

In a case where the determination result is negative (FIG. 11/STEP502 is determined to be NO), the display control unit 211 executes the processing of FIG. 11/STEP502.

In a case where the determination result is affirmative (FIG. 11/STEP502 is determined to be YES), the display control unit 211 displays a total score transition image screen M3 on the image display unit 250 (FIG. 11/STEP504).

Figure 12:
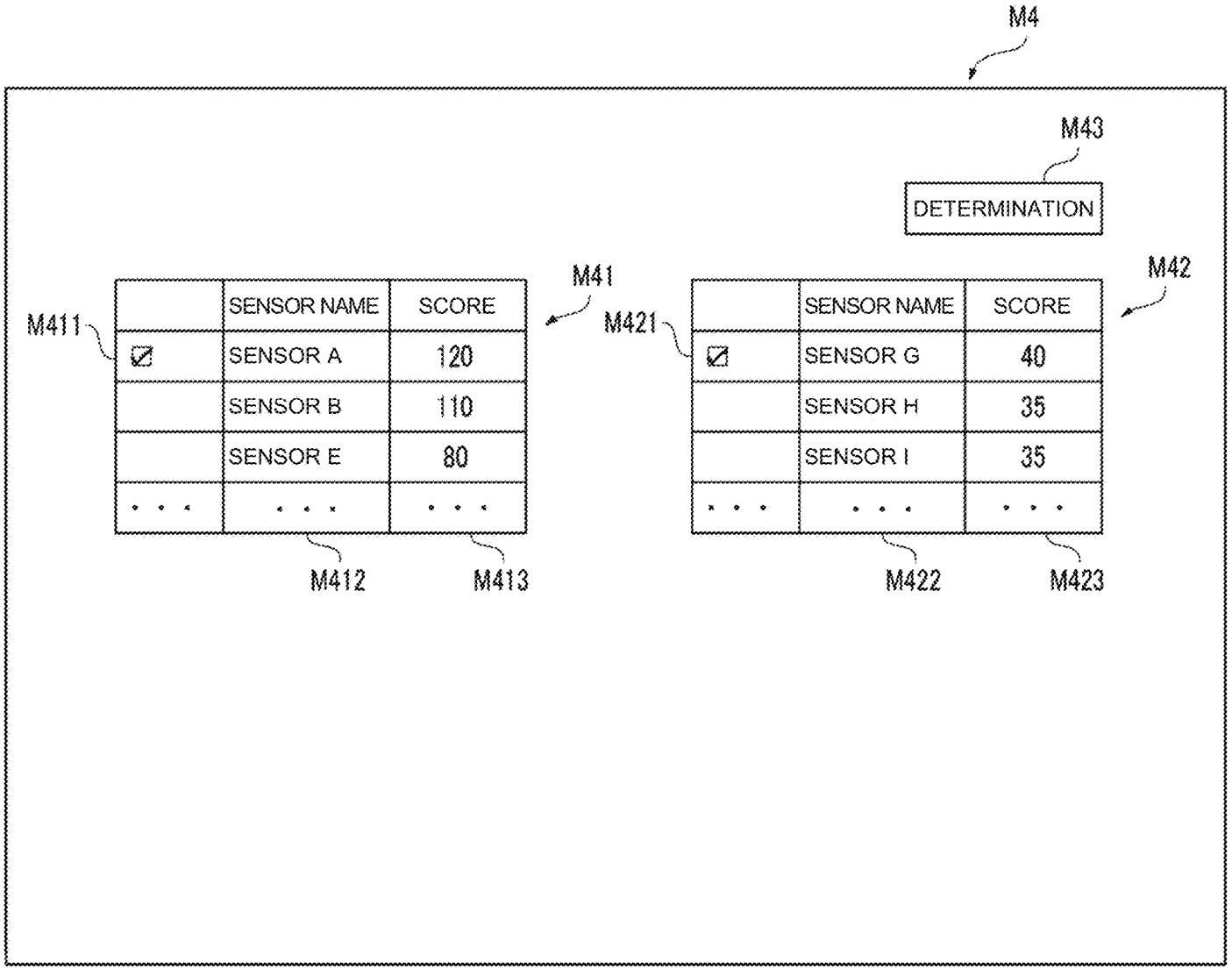
FIG. 12 is a diagram showing an example of a total score transition image screen.

The total score transition image screen M3 is a screen including a third sensor selection box M41, a fourth sensor selection box M42, and a determination button M43 as shown in FIG. 12.

The third sensor selection box M41 includes a selection column M411 for each of sensors, a name column M412 for each of the sensors, and a score column M413 for each of the sensors.

The fourth sensor selection box M42 includes a selection column M421 for each of sensors, a name column M422 for each of the sensors, and a score column M423 for each of the sensors, similar to the third sensor selection box M41. The display control unit 211 may dynamically update the fourth sensor selection box M42 so as to include a sensor with a high correlation coefficient with respect to sensors selected in the third sensor selection box M41.

The display control unit 211 determines whether or not a pressing operation of the determination button M33 has been detected through the user input reception unit 230 (FIG. 11/STEP506).

In a case where the determination result is negative (FIG. 11/STEP506 is determined to be NO), the display control unit 211 executes the processing of FIG. 11/STEP506.

In a case where the determination result is affirmative (FIG. 11/STEP506 is determined to be YES), the score recognition unit 213 recognizes an ID of a sensor selected in the selection column of the third sensor selection box M41 and an ID of a sensor selected in the selection column of the fourth sensor selection box M42 (FIG. 11/STEP508).

The score recognition unit 213 recognizes time-series transitions of scores of two sensors identified by two IDs recognized in FIG. 11/STEP508 (FIG. 11/STEP510).

The score recognition unit 213 recognizes time-series transitions of the sum of the scores of the two sensors recognized in FIG. 11/STEP510 (FIG. 11/STEP512).

The display control unit 211 displays a total score transition image screen M4 including a second score transition image M441 on the image display unit 250 (FIG. 11/STEP514).

Figure 13:
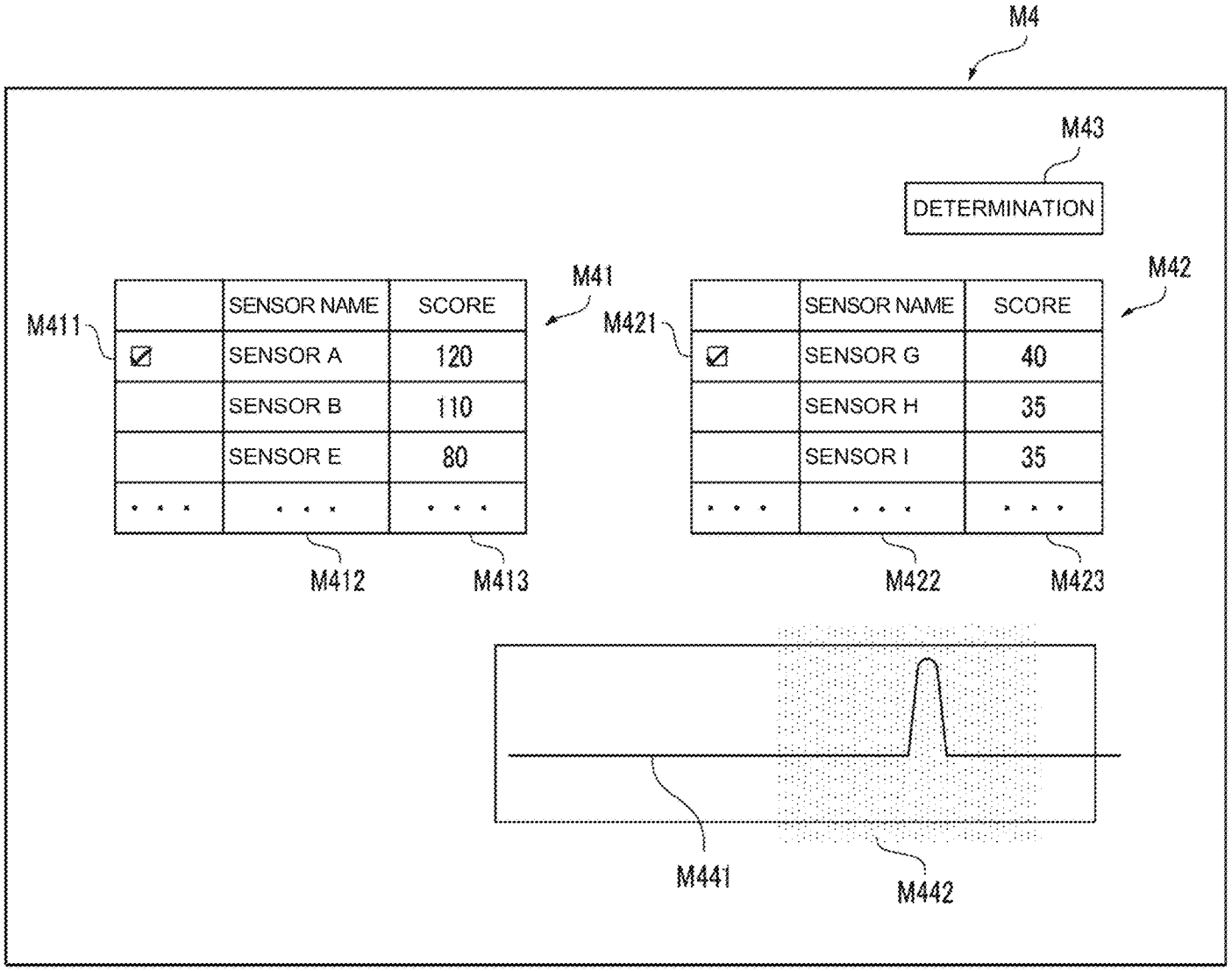
FIG. 13 is a diagram showing an example of the total score transition image screen including a second score transition image.

The total score transition image screen M4 displayed in FIG. 11/STEP514 includes the second score transition image M441 and a third period display image element M442 in addition to the above-described components, as shown in FIG. 13.

The second score transition image M441 is an image indicating time-series transitions of the sum of the scores recognized in FIG. 11/STEP512.

The third period display image element M442 is an image element indicating a first designated period or a second designated period.

(Sensor Output Value Comparison Process)

Next, a sensor output value comparison process will be described with reference to FIGS. 14 and 15.

In an initial state in the present process, the total score transition image screen M4 including the second score transition image M441 is displayed on the image display unit 250.

Figure 14:
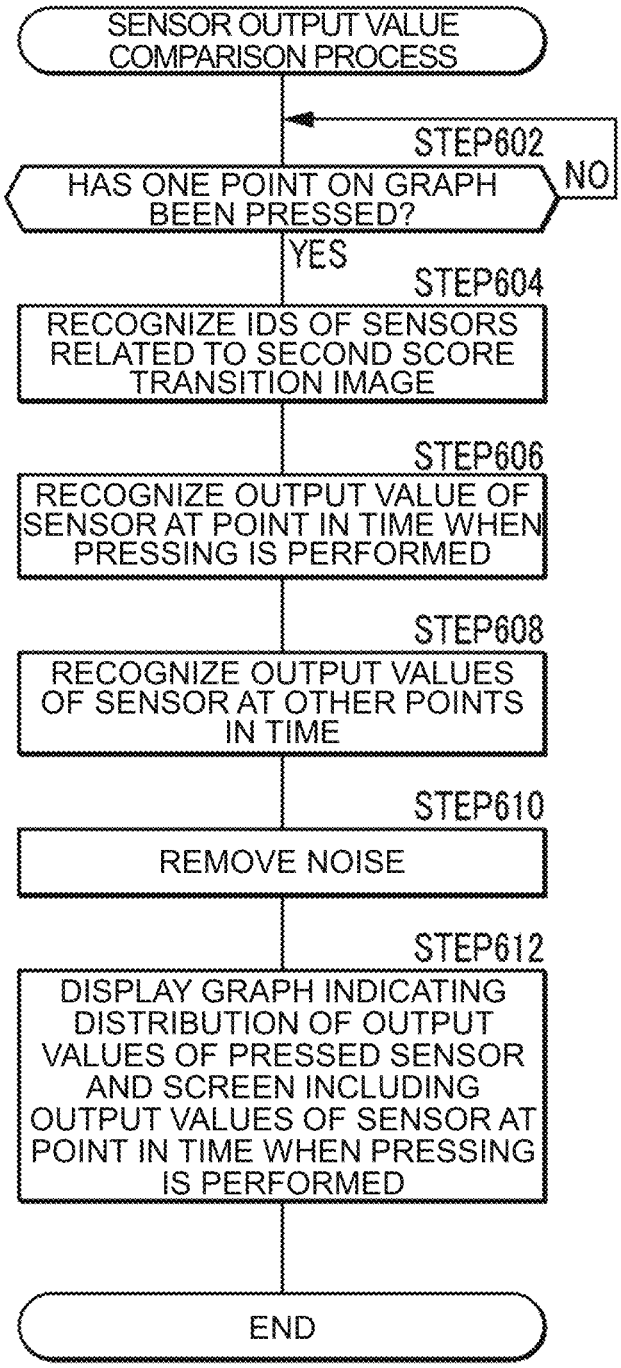
FIG. 14 is a flowchart of a sensor output value comparison process.

The display control unit 211 determines whether or not a pressing operation at one point on the second score transition image M441 has been detected through the user input reception unit 230 (FIG. 14/STEP602).

In a case where the determination result is negative (FIG. 14/STEP602 is determined to be NO), the display control unit 211 executes the processing of FIG. 14/STEP602.

In a case where the determination result is affirmative (FIG. 14/STEP602 is determined to be YES), the display control unit 211 recognizes IDs of two sensors related to the second score transition image M441 (FIG. 14/STEP604).

The display control unit 211 recognizes output values at a point in time corresponding to a position pressed in FIG. 14/STEP602 with respect to the two sensors identified by the two IDs recognized in FIG. 14/STEP604 (FIG. 14/STEP606).

The display control unit 211 recognizes output values at other points in time with respect to the two sensors identified by the two IDs recognized in FIG. 14/STEP604 (FIG. 14/STEP608). The score recognition unit 213 may recognize output values at other points in time inclusive of output values of sensors other than the whole period from the sensor data 221.

The display control unit 211 removes noise (FIG. 14/STEP610). For example, the display control unit 211 may exclude a temporary value by taking the centroid in time series with respect to time-series output values of sensors in a fixed period. Alternatively, the display control unit 211 may exclude a temporary value by performing density estimation processing from time-series output values of sensors in a fixed period. The display control unit 211 may omit the present process.

The display control unit 211 displays a sensor output value comparison screen M5 on the image display unit 250 (FIG. 14/STEP612).

Figure 15:
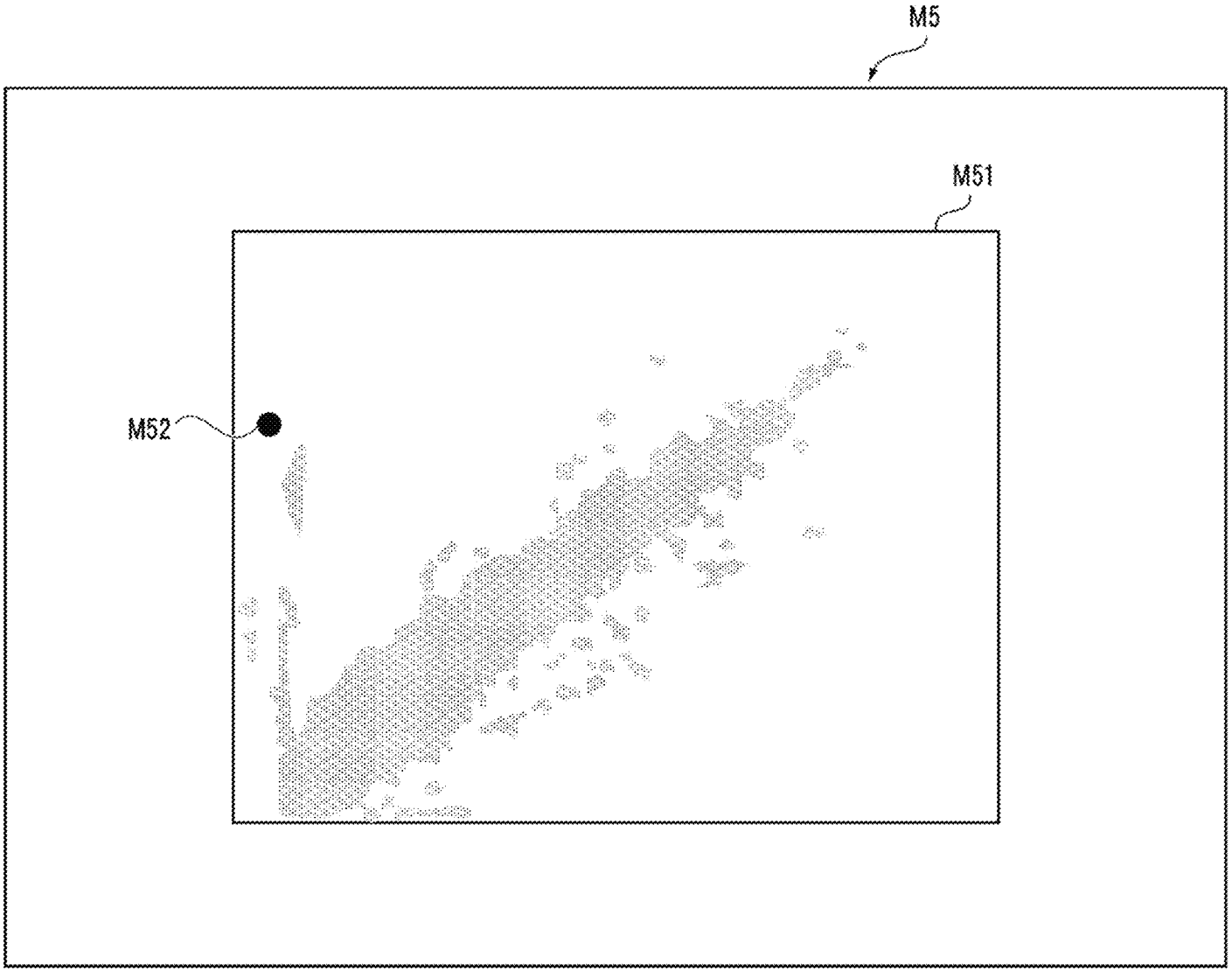
FIG. 15 is a diagram showing an example of a sensor output value comparison screen.

For example, the sensor output value comparison screen M5 includes a two-dimensional coordinate M51 in which an output value of one sensor is set to be a horizontal axis and an output value of another sensor is set to be a vertical axis as shown in FIG. 15. A large number of points each indicating a set of output values of the two sensors are displayed in the two-dimensional coordinate M51. Further, in the two-dimensional coordinate M51, a point M52 indicating a set of output values of the two sensors at a point in time corresponding to the position pressed in FIG. 14/STEP602 is displayed so as to be distinguishable from the other points.

(Operational Effects of the Present Embodiment)

According to the information output device 200 having this configuration, the first parameter transition image screen M1 and the second parameter transition image screen M2 are switched between and displayed on the image display unit 250 by the display control unit 211 in accordance with a user's input received by the user input reception unit 230 (FIG. 4/STEP206, STEP208, and STEP216).

Here, the first parameter transition image screen M1 is a screen including a first parameter transition image (first score transition image M142) indicating time-series transitions of first parameters of a plurality of types based on sensor data of a vehicle which is received by the sensor data input reception unit 240 before a first point in time.

In addition, the second parameter transition image screen M2 is a screen including a second parameter transition image (sensor output value transition image M262) indicating time-series transitions of second parameters of a plurality of types before a first point in time. The second parameters of a plurality of types are parameters corresponding to at least some of the plurality of types of first parameters.

In this manner, image elements indicating time-series transitions of a plurality of types of parameters corresponding to each other before a first point in time are displayed on a plurality of screens, so that it is possible to allow a user to examine time-series transitions of the plurality of types of parameters to the first point in time from a plurality of viewpoints.

Further, in a case where designation of a designated period before the first point in time is received by the user input reception unit 230 on the first parameter transition image screen M1 (FIG. 4/STEP202 is determined to be YES), the first period display image element M143 indicating a designated period is displayed on the first parameter transition image screen M1 on the image display unit 250 by the display control unit 211 (FIG. 4/STEP206).

In addition, the second period display image element M263 indicating a designated period is displayed on the image display unit 250 by the display control unit 211 also on the second parameter transition image screen M2 after switching from the first parameter transition image screen M1 (FIG. 4/STEP216).

Thereby, association between the parameters displayed on the plurality of screens can be easily understood, and thus convenience may be improved.

In addition, according to the information output device 200 having this configuration, the first parameter transition image is the first score transition image M142 indicating time-series transitions of a plurality of scores indicating whether or not the vehicle is in a designated state, and the second parameter transition image is the sensor output value transition image M262 indicating time-series transitions of output values of sensors shown in sensor data of the vehicle. In addition, the plurality of scores are numerical values determined on the basis of the output values of the sensors shown in the sensor data of the vehicle.

That is, in a case where designation of a second point in time or a designated period is received on the first parameter transition image screen M2 including the first score transition image M142 indicating time-series transitions of scores indicating whether or not the vehicle is in a designated state, the second period display image element M263 indicating the designated second point in time or designated period is also displayed on the second parameter transition image screen M2 together with the sensor output value transition image M262 indicating the time-series transitions of the output values of the sensors.

Thereby, for example, when a user examines general trends in the state of the vehicle on the first parameter transition image screen M1 and analyzes the output values of the sensors in more detail on the second parameter transition image screen M2, it is possible to allow the user to recognize association between the general trends in the state of the vehicle and the output values of the sensors.

According to the information output device 200 having this configuration, the score image M23 indicating one or a plurality of scores of at least some of the plurality of scores is displayed on the second parameter transition image screen M2 indicating the time-series transitions of the output values of the sensors shown in the sensor data of the vehicle. Thereby, for example, when the user examines the output values of the sensors on the second parameter transition image screen M2, the user can recognize at least some of the plurality of scores, and thus convenience may be improved.

In addition, according to the information output device having this configuration, one or a plurality of scores shown in the score image M23 are representative values of scores in a designated period.

Thereby, for example, in a case where the user designates a designated period as a period desired to be noted on the first parameter transition image screen M1, the sensor output value transition image M262 indicating time-series transitions of output values of sensors and the second period display image element M263 indicating a designated period are displayed on the second parameter transition image screen M2, and the score image M23 including representative values of one or a plurality of scores in the designated period is displayed thereon.

Thereby, it is possible to allow the user to ascertain a relation between time-series transitions of output values of sensors in the designated period and representative values of scores in the designated period, and thus convenience may be improved.

According to the information output device 200 having this configuration, the total score transition image screen M4 including the second score transition image M441 indicating time-series transitions of a total score calculated from a plurality of scores is displayed on the image display unit 250 by the display control unit 211 in accordance with the user's input received through the user input reception unit 230 (FIG. 11/STEP514).

Thereby, it is possible to allow the user to recognize relation between a plurality of scores shown in the first score transition image M142 displayed on the first parameter transition image screen M1, and thus convenience may be improved.

(Modification Mode)

In the above-described embodiment, the information output device 200 performs each process with a point in time when an output value of a sensor indicating a designated state is output as a first point in time. However, alternatively, each process may be performed by setting a point in time designated through the user input reception unit 230 by a user as a first point in time.

In the above-described embodiment, the display control unit 211 receives designation of a period on the first parameter transition image screen M1 (FIG. 4/STEP202 is determined to be YES, FIG. 4/STEP204), displays the first period display image element M143 indicating the designated period on the image display unit 250 (FIG. 4/STEP206), and displays the second parameter transition image screen M2 including the second period display image element M263 indicating the designated period (designated period) on the image display unit 250 (FIG. 4/STEP216), but is not limited thereto.

For example, the display control unit 211 may receive designation of a point in time on the first parameter transition image screen M1, may display an image element (equivalent to an example of the "first point in time period display element" of the present disclosure) indicating the designated point in time (equivalent to an example of the "second point in time" of the present disclosure) on the image display unit 250, and may display a second parameter transition image screen including an image element (equivalent to an example of the "second point in time period display element" of the present disclosure) indicating the designated point in time on the image display unit 250. In this case, the display control unit 211 may include the designated-point-in-time image M271 indicating a designated point in time and the sensor output value image M272 indicating output values of sensors at the designated point in time in the second parameter transition image screen through the same process as the anchor display process of FIG. 9.

In the above-described embodiment, the display control unit 211 receives designation of a period on the first parameter transition image screen M1 (FIG. 4/STEP202 is determined to be YES, FIG. 4/STEP204) and displays the second parameter transition image screen M2 including the score image M23 including representative values of one or a plurality of scores in the designated period (designated period) on the image display unit 250 (FIG. 4/STEP216), but is not limited thereto. For example, the display control unit 211 may receive designation of a point in time on the first parameter transition image screen M1 and may display a second parameter transition image screen including a score image including one or a plurality of scores at the designated point in time on the image display unit 250.

The total score transition image screen M4 includes the second score transition image M441 indicating time-series transitions of the sum of two scores. However, alternatively or additionally, the total score transition image screen may include an image indicating time-series transitions of values derived from two scores such as a difference, product, or ratio between the two scores. In addition, the total score transition image screen M4 is not limited to an image indicating time-series transitions of values derived from two scores, and may include an image indicating time-series transitions of values derived from two or more scores.

The display control unit 211 displays the sensor output value comparison screen M5 in a case where a pressing operation for one point on a graph on the total score transition image screen M4 is detected. However, alternatively or additionally, the sensor output value comparison screens M5 for two sensors may be displayed on the image display unit 250 on condition that an operation of selecting the two sensors is performed on the first parameter transition image screen M1 or the second parameter transition image screen M2 and an operation of designating one point in time is performed.

The display control unit 211 may display the total score transition image screen M4 for two or more sensors on the image display unit 250 on condition that an operation of selecting the two or more sensors is performed on the first parameter transition image screen M1 or the second parameter transition image screen M2.

An operation of selecting a sensor and an operation of designating a point in time are not limited to an operation of pressing one point on a graph of the sensor, and any operation may be performed as long as the operation is an operation of inputting information for specifying an ID of a sensor and a designated point in time.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An information output device comprising:

an image display unit that displays an image;

a user input reception unit that receives an input from a user;

a sensor data input reception unit that receives an input of sensor data of a vehicle; and a display control unit that switches between a first parameter transition image screen and a second parameter transition image screen in accordance with the input of the user received by the user input reception unit and displays the screens on the image display unit, the first parameter transition image screen including a first parameter transition image indicating time-series transitions of first parameters of a plurality of types based on the sensor data of the vehicle which is received by the sensor data input reception unit before a first point in time, and the second parameter transition image screen including a second parameter transition image indicating time-series transitions of second parameters of a plurality of types corresponding to at least some of the first parameters of a plurality of types before the first point in time, wherein in a case where a second point in time before the first point in time or a designated period is received by the user input reception unit on the first parameter transition image screen, the display control unit is configured to cause a first period display image element indicating the second point in time or the designated period on the first parameter transition image screen to be displayed on the image display unit and cause a second period display image element indicating the second point in time or the designated period on the second parameter transition image screen after switching from the first parameter transition image screen to be displayed on the image display unit, wherein the first parameter transition image is a first score transition image indicating time-series transitions of a plurality of scores each indicating whether or not the vehicle is in a designated state, the plurality of scores are numerical values determined on the basis of output values of sensors indicated in the sensor data of the vehicle, and the second parameter transition image is a sensor output value transition image indicating time-series transitions of the output values of the sensors indicated in the sensor data of the vehicle.

2. The information output device according to claim 1, wherein the second parameter transition image screen includes a score image indicating one or at least some of the plurality of scores.

3. The information output device according to claim 2, wherein one or a plurality of scores indicated in the score image are scores at the second point in time, or one or a plurality of scores indicated in the score image are representative values of scores in the designated period.

4. The information output device according to claim 1, wherein the display control unit is configured to display a total score transition image screen including a second score transition image indicating time-series transitions of a total score calculated from a plurality of scores on the image display unit in accordance with the input of the user received through the user input reception unit.

5. The information output device according to claim 2, wherein the display control unit is configured to display a total score transition image screen including a second score transition image indicating time-series transitions of a total score calculated from a plurality of scores on the image display unit in accordance with the input of the user received through the user input reception unit.

6. The information output device according to claim 3, wherein the display control unit is configured to display a total score transition image screen including a second score transition image indicating time-series transitions of a total score calculated from a plurality of scores on the image display unit in accordance with the input of the user received through the user input reception unit.

7. An information output method which is a method executed by a computer including an image display unit that displays an image, a user input reception unit that receives an input of a user, and a sensor data input reception unit that receives an input of sensor data of a vehicle, the information output method comprising:

displaying a first parameter transition image screen on the image display unit, the first parameter transition image screen including a first parameter transition image indicating time-series transitions of first parameters of a plurality of types based on the sensor data of the vehicle which is received by the sensor data input reception unit before a first point in time;

receiving a second point in time before the first point in time or a designated period on the first parameter transition image screen through the user input reception unit;

causing a first period display image element indicating the second point in time or the designated period on the first parameter transition image screen to be displayed on the image display unit; and causing a second parameter transition image screen to be displayed on the image display unit in accordance with the input of the user received by the user input reception unit, the second parameter transition image screen including a second parameter transition image indicating time-series transitions of second parameters of a plurality of types corresponding to at least some of the first parameters of a plurality of types before the first point in time and a second period display image element indicating the second point in time or the designated period, wherein the first parameter transition image is a first score transition image indicating time-series transitions of a plurality of scores each indicating whether or not the vehicle is in a designated state, the plurality of scores are numerical values determined on the basis of output values of sensors indicated in the sensor data of the vehicle, and the second parameter transition image is a sensor output value transition image indicating time-series transitions of the output values of the sensors indicated in the sensor data of the vehicle.

* * * * *